United States Patent [19]

Sato

[11] 4,197,799

[45] Apr. 15, 1980

[54] LABEL ARRANGING DEVICE FOR LABEL PRINTING MACHINE

[75] Inventor: Yo Sato, Tokyo, Japan

[73] Assignee: Kabushiki Kaisha Sato Kenkyusho, Tokyo, Japan

[21] Appl. No.: 860,831

[22] Filed: Dec. 15, 1977

[30] Foreign Application Priority Data

Feb. 4, 1977 [JP] Japan ..... 52/010828

[51] Int. Cl.[2] ..... B41F 1/06; B41F 3/44; B41J 3/00

[52] U.S. Cl. ..... 101/291; 101/288; 400/613.3; 226/53; 156/540

[58] Field of Search ..... 101/287, 288, 291, 292; 400/613.3, 135, 127, 695; 226/53, 76, 82–85; 156/540

[56] References Cited

U.S. PATENT DOCUMENTS 4,026,758 5/1977 Sako ..... 156/540

4,075,944 2/1978 Conley ..... 101/288

FOREIGN PATENT DOCUMENTS 2339062 4/1974 Fed. Rep. of Germany ..... 101/288

2614690 10/1977 Fed. Rep. of Germany ..... 400/613.3

*Primary Examiner*—William Pieprz

*Attorney, Agent, or Firm*—Ostrolenk, Faber, Gerb & Soffen

[57] ABSTRACT

A label arranging device for use in a label printing machine: a layered label strip having spaced feed perforations is moved forward by engagement of the perforations with feed pins formed on a feed wheel; the label strip is imprinted on a platen by the type faces of a printing head; the label arranging device includes an arranging member having an arranging surface on its bottom; the feed lips that were formed at the feed perforations by the feed pins are depressed and flattened by the arranging surface of the arranging member.

10 Claims, 8 Drawing Figures

LABEL ARRANGING DEVICE FOR LABEL PRINTING MACHINE

BACKGROUND OF THE INVENTION

This invention relates to a label arranging device for a label printing machine.

The label pieces that are being arranged are carried on a tape-like backing strip thereby forming a layered label strip. The label pieces have feed perforations.

A label strip comprises a tape-like backing strip and a plurality of label pieces which are temporarily secured by an adhesive layer on their rear surfaces in a side-by-side array on the backing strip. There are feed perforations formed in the label strip and located so at to bridge across the borders between adjoining label pieces. The feed perforations are engaged by feed pins that are formed around a feed wheel in the label printing machine. When a hand lever is operated, the feed wheel is intermittently rotated through a certain angle to move the label strip that is in engagement with the feed pins forward through the machine a predetermined distance. Each label piece is moved by the fed wheel onto an imprinting platen. The label piece is printed on the platen.

During feeding, the layered label strip is fitted against the upper surface of the feed wheel and with the feed pins formed on the feed wheel. Feed lips or lugs are bent up at the feed perforations as they are engaged by the feed pins on the feed wheel. The feed lips at the rear side of each label piece are bent perpendicularly upwardly since the feed wheel pins apply the force to push and move the label strip from the rear of each label strip. The feed lips remain bent upright as the label pieces are transferred onto the platen.

Upright feed lips interfere with clear and complete imprinting on the platen. When label pieces with upright feed lips are printed, the feed lips are refolded down on the label pieces. The printed characters are, however, not completely printed. Further, the bent feed lips turn up and flutter so that the type faces of the printing head label surfaces on the platen are liable to become unparallel. As a result, blurred or indistinct printing occurs.

Furthermore, when label pieces with upstanding feed lips are applied to articles, the applied labels have an unattractive appearance because they are partially bent up. In addition, the applied labels sometimes peel off at the bent portions and this hurts the appearance of the labeled articles.

After printing, in a narrow space in front of the platen, the backing strip is peeled from the printed label pieces by the backing strip being bent sharply downwardly and rearwardly, forming a loop of the backing strip. The separated backing strip is led under the feed wheel and is again brought into engagement with the feed pins of the feed wheel so that the backing strip is delivered toward the rear of the machine body.

SUMMARY OF THE INVENTION

It is the principal object of the present invention to provide a label arranging device for a label printing machine in which the bent feed lips on individual labels are depressed and flattened on the surface of a platen.

A further object of the present invention is to provide a label arranging device for a label printing machine, which enables high quality printing of label pieces and reliable application of printed label pieces.

A still further object of the present invention is to provide a label arranging device, which is simple and compact enough to be made easily at low cost and to be used for a long time without any trouble.

In accordance with the present invention, the label arranging device comprises an arranging member which is attached to a portion of the printing head in the labelling machine. The arranging member has an arranging surface on its bottom side to depress and flatten the feed lips formed from the feed perforations of the label strip. The arranging member is positioned on the locus formed by the turning movement of the type faces of the printing head about a pivotal shaft. The arranging member is located upstream with respect to the movement of the label strip relative to the position of the type faces in the printing position. The arranging member is simultaneously operated during label printing.

BRIEF DESCRIPTION OF THE DRAWINGS

The foregoing and other objects and features of the present invention will become more apparent from the following description of a preferred embodiment, taken in connection with the accompanying drawings, in which.

DESCRIPTION OF A PREFERRED EMBODIMENT

Figure 1:
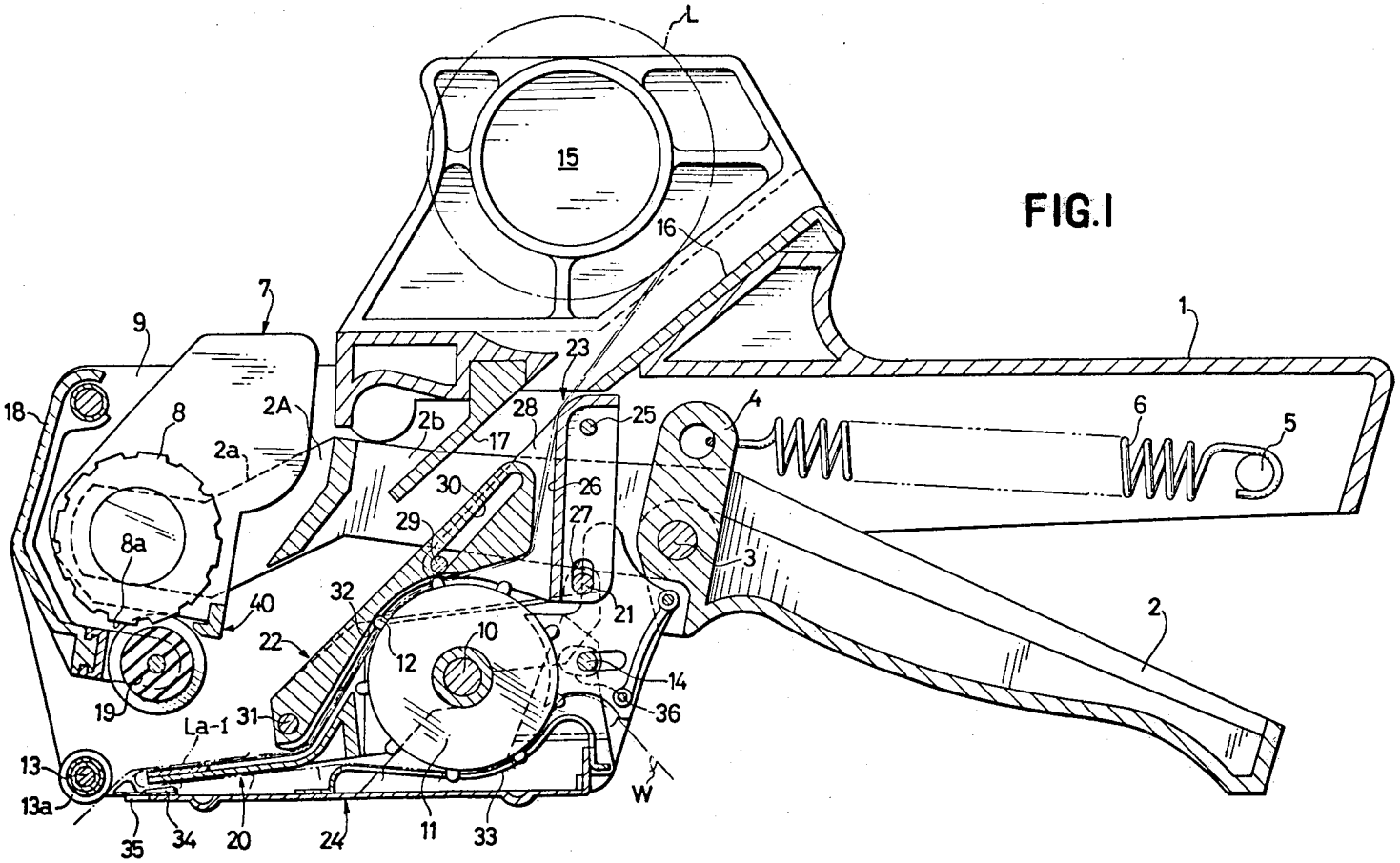
FIG. 1 is a cross-sectional side elevational view of a label printing machine, which is provided with the label arranging device of the present invention, in which the machine frame on the viewing side is removed, and the machine is in stationary position.

FIG. 1 shows a label printing machine which is provided with the label arranging device of the present invention. The label printing machine comprises a pair of spaced apart, parallel, rigid frames 9, including a hand grip 1 at the rear (right hand) portion. A hand lever 2 is pivotally secured to the frames at a pivot shaft 3. A tensioned return spring 6 is stretched between a spring holding member 4 formed on the hand lever 2 and another spring holding member 5 formed in the hand grip 1. When the hand lever 2 is squeezed toward the hand grip 1, the return spring 6 is charged. When the hand lever 2 is released, the hand lever is returned to the original stationary position by the force of the return spring 6.

The forwardly elongated portions of the hand lever 2 in front of the shaft 3 comprise a pair of operation levers 2A, which are comprised of a print section 2a further from shaft 3 and a drive section 2b nearer the shaft. The print section 2a at the forward end of operating levers 2A is equipped with a printing head 7 carrying a plurality of printing wheels 8. Each printing wheel 8 is provided with a plurality of imprintable types 8a on its exterior periphery. The types can be selected by rotating the printing wheel 8. The drive section 2b of levers 2A is provided with driving members for intermittently rotating a feed wheel 11, described further below.

Figure 3:
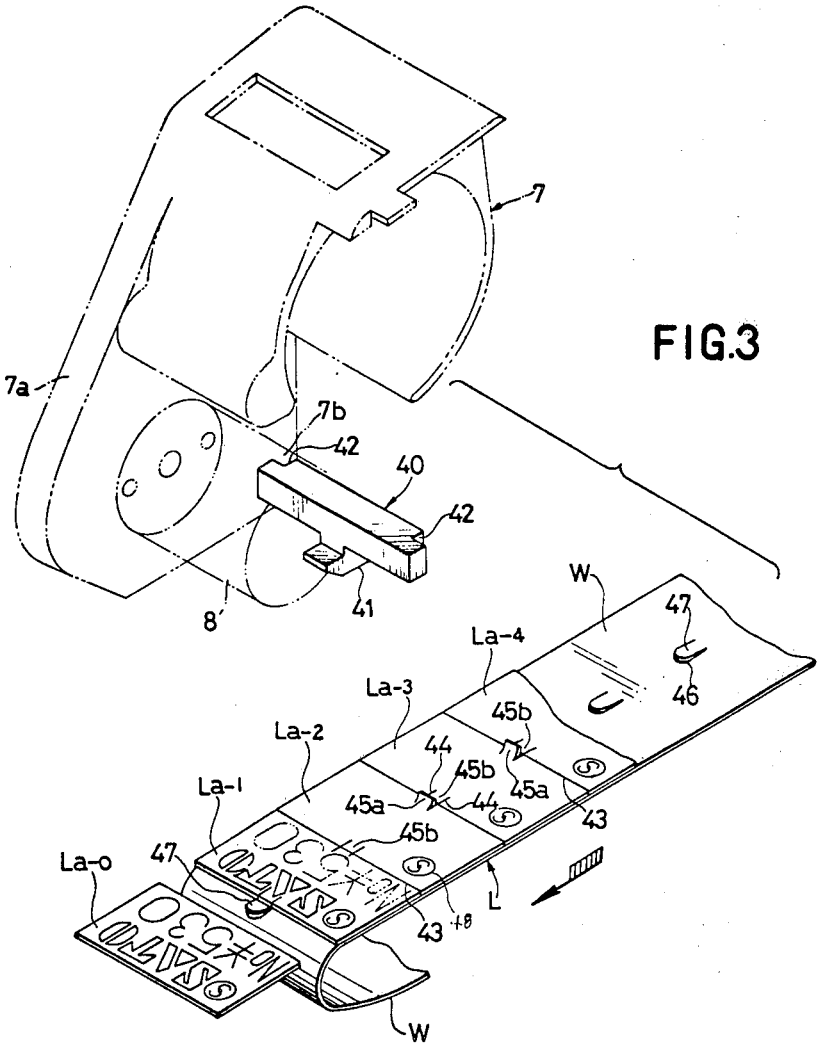
FIG. 3 is an exploded perspective view of the label arranging device of the present invention and a perspective view of a label strip.
Figure 4:
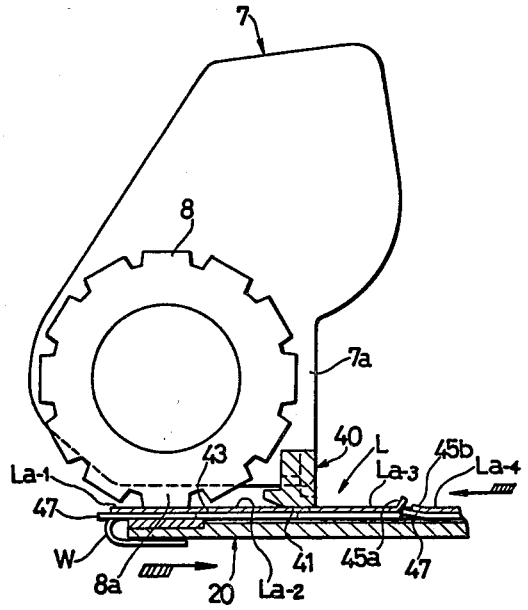
FIG. 4 is a cross-sectional side elevational view of the same elements as FIG. 3.
Figure 5:
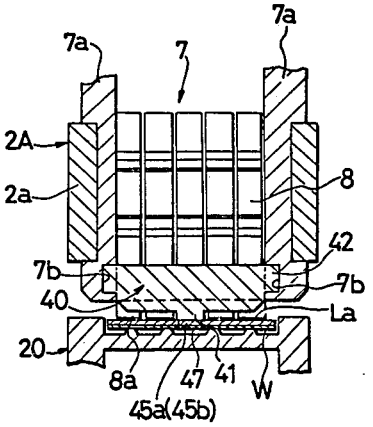
FIG. 5 is a cross-sectional front elevational view of the same elements.

As shown in FIGS. 3 to 5, the printing head 7 rigidly supports a label arranging member 4 having an L-shaped vertical cross-section, as seen in FIG. 4. The bottom leg of the L comprises a planar arranging surface 41 at the rear portion and on the bottom surface of the member 40. The planar arranging surface 41 beneath member 40 is positioned at the local plane formed by the faces of the type 8a that is at the printing position and is against the surface of platen 20. Member 40 is positioned between the pair of side frames 7a that define the printing head 7 and at the lower rear portion of the printing wheels 8 in the lower rear part of the printing head. The fixing ridges 42 formed on both sides of the arranging member 40 are inserted into the fixing grooves 7b that are defined in the inside faces of the side walls of frames 7a.

The precise configuration and position of the arranging member 40 described above is not restrictive. Any configuration and position which is able to flatten the bent feed lips 45a and 45b of label pieces La may be used.

Returning to FIG. 1, the feed wheel 11 that is driven by the drive section 2b of the operating lever 2A, is pivotally secured to a main shaft 10 that is fitted between the pair of machine frames 9. The feed wheel 11 is intermittently rotated upon the releasing of the hand lever 2 after it has been squeezed. The peripheral surface of the feed wheel 11 has a plurality of feed pins 12 attached around it at regular intervals.

As shown in FIG. 3, the label strip L with which the device of the present invention is used has a laminated structure comprising a plurality of label pieces La-1, La-2, La-3, La-4, etc. which are temporarily fastened in a side-by-side series on a backing strip W. The undersides of the label pieces have adhesive layers for attaching them to the backing strip W and, after label printing, for attaching them to the surfaces of articles to be labelled. Pre-cut lines 43 are formed between the label pieces La-1, La-2, La-3, etc. Two feed perforations 44 perpendicularly cross over the middle portion of each pre-cut line 43 between two label pieces. The feed perforations 44 are formed on the borders of label pieces La-1, La-2, La-3, La-4, etc. of the label strip L. When the label strip L is brought into engagement with the feed pins 12 of the feed wheel 11, the lug portions between two feed perforations 44 are bent up to form feed lips 45a and 45b when they are pushed up by the tip ends of the feed pins 12. Feed lip 45a is formed at the trailing end of leading label La-2 and feed lip 45b is formed at the leading end of trailing label La-3.

The backing strip W has generally U-shaped cuts 46 therein. Each cut 46 is aligned beneath a set of feed lips 45a and 45b and each cut 46 is of a length to extend across neighboring feed lips 45a and 45b. The curve of the U of cuts 46 is at the forward ends of these cuts and the feed pins engage the rounded forward ends. Cuts 46 define feed lips 47. However, the rounded portion can alternatively be reversely formed. The feed lips 47 are bent upright when they are engaged by the feed pins 12 of the feed wheel 11. However, each feed lip 47 can be returned to its original flat position simultaneously with the flattening of the respective feed lip 45a of a label piece La by means of the arranging member 40.

The upwardly bent feed lips 45a, 45b and 47 are flattened by the arranging member 40 in the label feeding operation.

As shown in FIG. 4, as each label piece La-1, La-2, etc. is moved in its turn just below the face of the type 8a in the printing position, the arranging member 40 is so positioned that it comes into contact with the respective feed lips 45a, 45b and 47 between the label pieces.

The label printing machine is provided with a label inserting device of the type described in U.S. application Ser. No. 837,193, filed Sept. 28, 1977, entitled "Label Strip Inserting Device". The inserting device comprises a platen 20, over which the label strip L is moved, a label guide member 22 above the label strip for depressing the label strip, an operating member 23 to guide the label strip L, a label guide piece 16 formed on a part of a label holder 15 carrying a roll of label strip L, another label guide piece 17 which is positioned above the elongated portion of the label guide piece 16, and a bottom cover 24 having curved guide members 33 thereon to guide the backing strip W of the label strip L with pressure after the backing strip has been separated from the label strip.

The platen 20 is provided on its rear (right) side with a short arm and with a long arm. Both of these arms have shaft holes. The platen 20 is pivotally secured to the main shaft 10 of the feed wheel 11 through the shaft holes. At the rear tip end of the long arm, a pin 21 is formed. It is fitted into a slot 27 of the operating member 23.

The side walls of the operating member 23 define a rectangular frame and are extended forward, forming a pair of arms 28. The side walls of the operating member 23 are further provided on their outsides with outwardly projecting pins 25, with which the member 23 is pivotally attached to the machine frames 9. When the operating member 23 revolves in operation, the planar label guide surface 27 of the rectangular frame serves as a guide surface for inserting the label strip L into the machine body. Pins 29 are formed on the inside walls of the arms 28. Slits 30 are formed in a pair of arms in the rear part of the label guide member 22. The pins 29 are fitted into the slits 30 of the label guide member 22 which is pivoted to the machine frames 9. Thus, through the action of the pins 29, the operating member 23 is turned about the pins 25.

The label guide member 22 is pivotally secured to the machine frames 9 by a pair of pins 31 that are attached to the front end portion of the member 22. The pins 31 are formed on the outsides of a pair of arms at the front part of the guide member 22. Further, the label guide member 22 has a curved undersurface portion 32 which together with the upper surfaces of the feed wheel 11 and the platen 20 forms a narrow label passage for the label strip L.

The front end of the bottom cover 24 is pivotally secured to the machine frames 9 with a pivot shaft 13 so the cover can be opened in the clockwise direction about the shaft 13. When the bottom cover 24 is closed, it is fastened to the machine frames 9 through the fixing members 36 on the cover engaging the locking device 14. At the rear of and on the top side of the bottom cover 24, two curved guide member pieces 33 are formed. These lie along the lower peripheral surface of the feed wheel 11. Attached to the front portion of the bottom cover 24 is a guide member 34 for the label strip L. The guide member has a notch 35 that is opened toward the shaft 13.

The label strip L is loaded into the label printing machine. The bottom cover 24 is turned clockwise to open it, and the platen 20 within the machine body is turned counterclockwise about the main shaft 10 to open the platen 20. Interlocking with the opening of the platen 20, the label guide surface 26 of the operating member 23 is turned until it becomes aligned with the inclined label guide piece 16 to form a label guiding surface. At the same time, the label guide member 22 is separated from the peripheral surface of the feed wheel 11, forming a label insertion passage to facilitate the loading of the label strip L.

Figure 6:
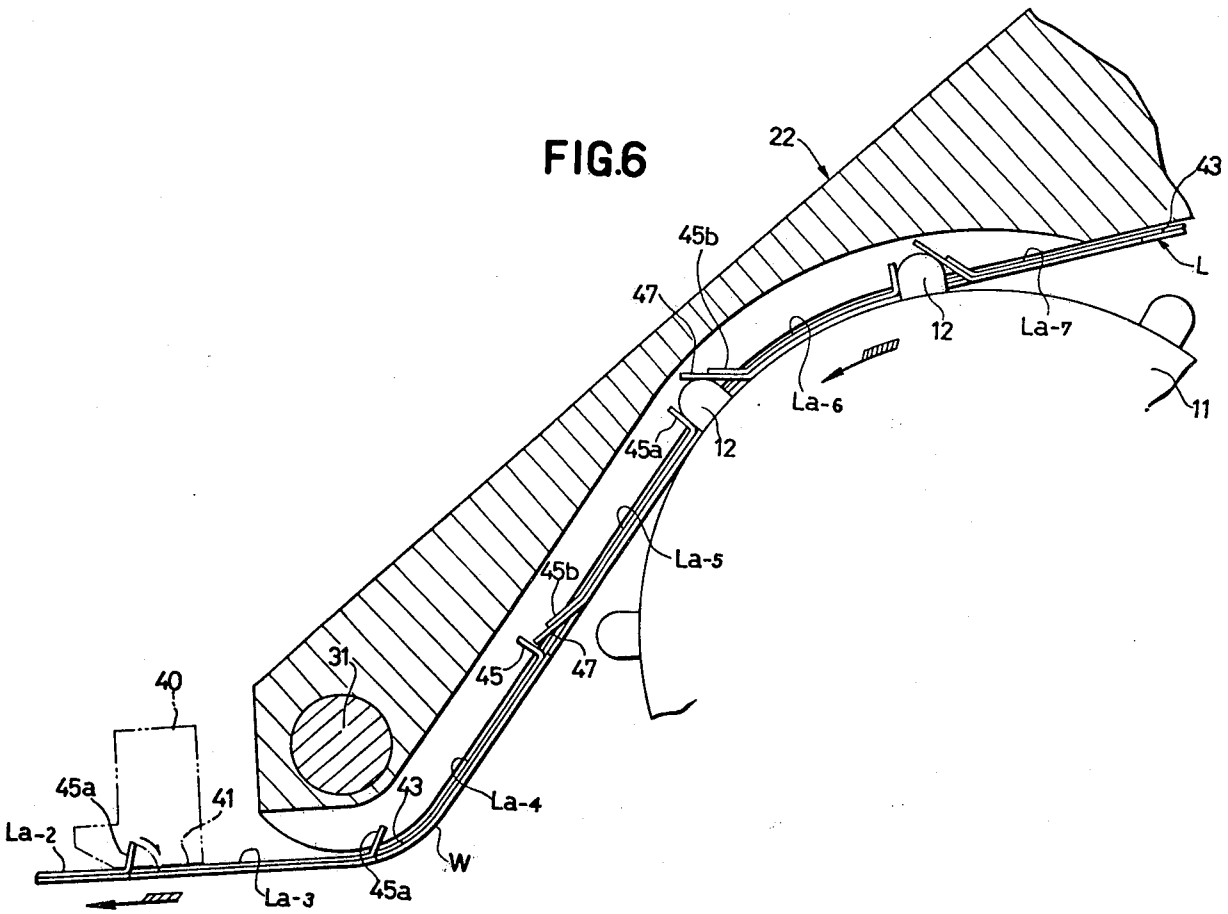
FIG. 6 is an enlarged side view of a label strip which is being moved forward by and is in engagement with the feed pins of a feed wheel.

Then the label strip L is inserted into the above described passage. The opened platen 20 and bottom cover 24 are closed, thereby completing the loading of the label strip L, as shown in FIGS. 1 and 6. The label strip L is depressed over the upper portion of the feed wheel 11 by the label guide member 22, and the feed perforations 44 and 46 of both of the label pieces La-1, La-2, La-3, etc. and the backing strip W are brought into engagement with the feed pins 12 on the wheel 11. Further, the leading portion of the label strip L passes over the platen 20 and into the narrow space at the front end of the platen 20. Only the backing strip W is turned downwardly and rearwardly forming a loop in front of the platen. Each label piece La is peeled from the backing strip W at the loop in the backing strip. The rearwardly moving backing strip W is further depressed against the lower portion of the feed wheel 11 by the curved guide members 33 of the bottom cover 24, and the feed pins 12 of the wheel 11 are again brought into engagement with the feed perforations 46.

Figure 2:
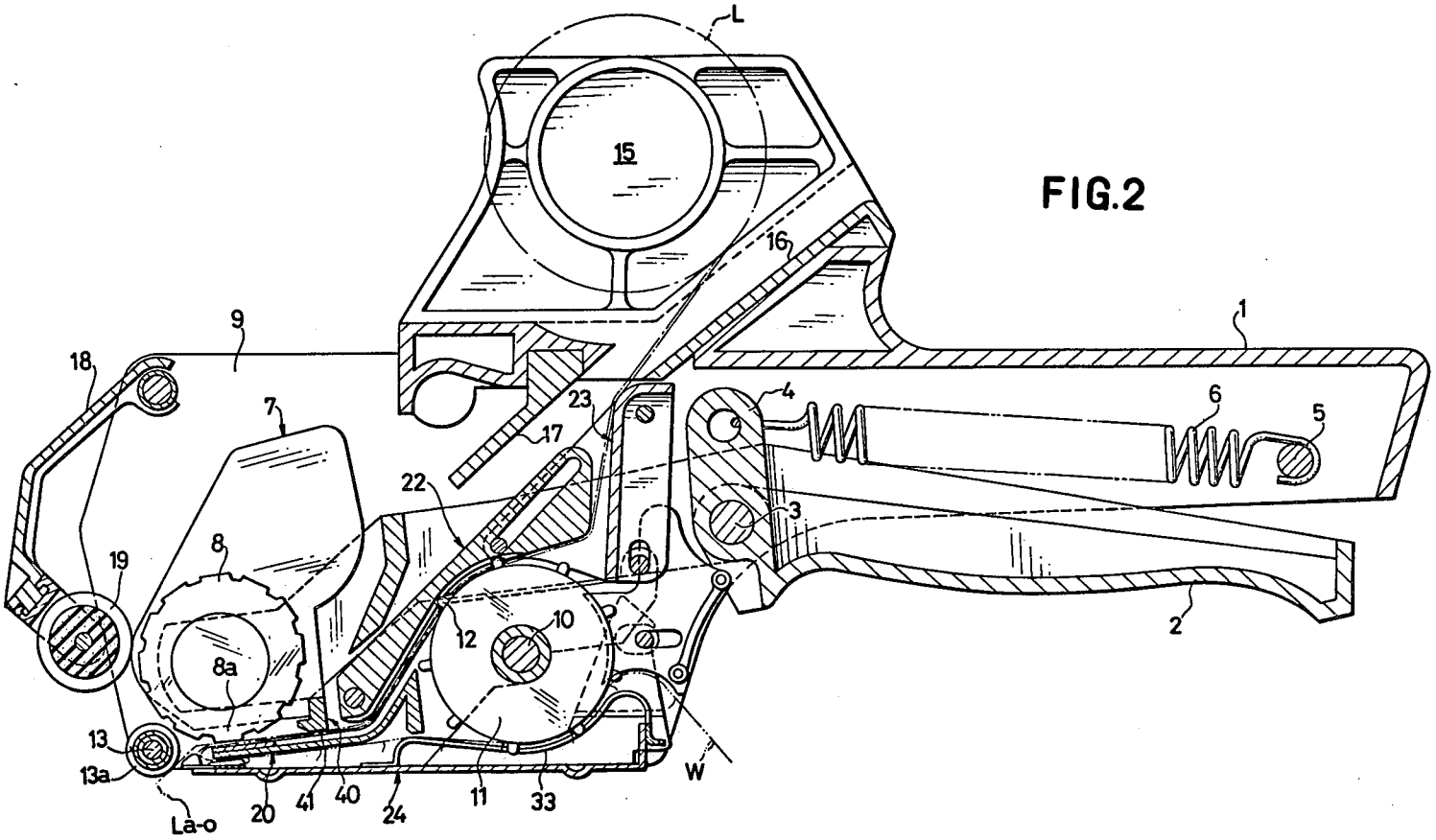
FIG. 2 is the same type of view as FIG. 1, with the label printing machine in the printing position and the label arranging device in operation.

The operation of the label arranging device of the invention is now described. During operation of the label printing machine, it repeatedly moves from the stationary position of FIG. 1 (hand lever 2 is released) into the printing position of FIG. 2 (hand lever 2 is squeezed). When the hand grip 1 and the hand lever 2 are squeezed, the operating levers 2A are pivoted downwardly. The inking roller 19 attached to the pivoting, normally rearwardly spring biased, inking arm 18 is interlocked with the descent of the levers 2A so that the inking roller applies ink to the surfaces of types **8*a* of the printing head 7. Then the label strip L carried on the platen 20 is printed by the descending type 8*a* then in the printing position. When the hand lever 2 is released, the feed wheel 11 is turned counterclockwise through a certain angle equivalent to the length of one label piece by the drive section of operating levers 2A under the force of the return spring 7**. As a result, the label strip L is advanced for the length of one label.

As shown in FIG. 6, the feed pins 12 on the outer surface of the feed wheel 11 engage the feed perforations 44 and 46 of both the label pieces La and the backing strip W. Accordingly, as shown in FIG. 3, the feed lips **45*a*, 45*b* and 47 of the label strips and backing strip are pushed up by the feed pins 12. The feed lip 45*a* on the rear side of each label piece La are bent up perpendicularly. The rounded portions of the U-shaped cuts of the backing strip W come into contact with the front faces of the feed pins 12** so as to move the label strip L forward.

Although the feed lips **45*b* on the front sides of label pieces La and the feed lips 47 of the backing strip W are bent up with some inclination by the feed pins 12, they nearly self restore to their original even level due to the resiliency of the label strip materials. However, as shown in FIG. 6, the feed lips 45*a* on the rear sides of the label pieces La-6, La-5, La-4, La-3 and La-2 are bent upright since they receive the driving force for moving the label strip L. The label pieces would be transferred onto the platen 20 with upstanding feed lips 45*a* and 47**.

Before the label piece La-2 is printed, by the types **8*a*, the upstanding feed lip 45*a* of the label piece La-2 and the upstanding feed lips 47 of the backing strip are corrected into their original flattened state by the arranging surface 41 of the label arranging member 40 that is interlocked with the printing head. When the label piece La-1 is being printed, the next label piece La-2 in sequence is simultaneously being brought under the arranging member for flattening its feed lips 45*a* and 47. Thus, the label piece La-1, whose feed lips 45*a* and 47 were previously flattened, can be passed smoothly over the platen 20**. Therefore, excellent quality printing is obtained since there is no longer any obstacle to such printing above the surface of the label to be printed.

Figure 7:
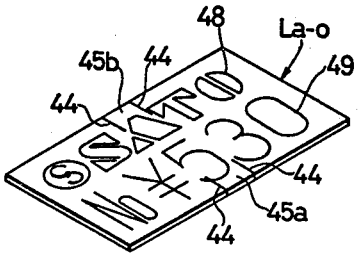
FIG. 7 is a perspective view of a label piece which has been operated upon by the label arranging device of the present invention.
Figure 8:
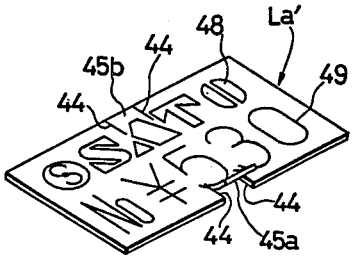
FIG. 8 is a perspective view of a label piece which has been processed by the conventional method.

The printed label piece La-1 is next peeled from the looped backing strip W at the front end of the machine body and it is led out through the space under the label applying member **13*a*. The label piece La-0 that is now positioned under the label piece applying member 13*a* is attached to the surface of an article to be labeled. The condition of the attached label piece La-0 is shown in FIG. 7. Its formerly upwardly bent feed lip 45*a* is made flat and even. The upper surface of the label piece La-0 has been printed with characters 48** showing, for example, the name of a store or the price of an article.

Because the label arranging member is moved in synchronism with the type faces of the printing head, the bent label pieces can be successfully corrected to their original flat position by the label arranging member simultaneously with the printing by the printing head against a label piece on the platen.

The following advantages are obtained with the invention:

(1) The label strip has a satisfactory imprintable surface on the platen. Thus poor print quality can be eliminated.

(2) Since the feed lips on the edges of label pieces are flattened, the appearance of applied label pieces is good and smooth. In addition, the applied label pieces can be prevented from being peeled off.

(3) Since the label arranging member is directly attached to the frame of the printing head, the correction of the upwardly bent feed lips can be attained simultaneously with the printing of the label pieces. In addition, the bent feed lips can be flattened easily without special operation members having to be built into the machine body.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A label printing machine for printing labels, comprising: means in said machine for defining a path of movement for a strip of labels through said machine; label strip feed means in said label strip path of movement and including feed pins for engaging a label strip, for pushing through the label strip and for defining upraised feed lips on the label strip as said feed pins engage and move the label strip; said feed means being adapted for feeding a label strip over a platen;

a printing head including types for imprinting label pieces of the label strip; a platen in said label strip path of movement and opposable to said types; said platen being held relatively stationary in said machine and said printing head being relatively movable towards and away from said platen; means for moving said printing head towards and away from said platen, thereby to imprint a label piece then on said platen; said feed means being adapted to feed a label strip to move between said printing head and said platen; a label arranging device, comprising: an arranging member attached to said printing head and moving therewith, said arranging member positioned in said machine and having an arranging surface in said label strip path of movement which is opposed to the surface of the label strip passing by said arranging surface and is located downstream in said path of movement from said feed means and upstream of said types in said label strip path of movement and being so placed across the width of the path of movement of the label strip through said machine for engaging and flattening the upraised feed lips of the label strip as the label strip is moved past said arranging surface by said feed means.

2. The label printing machine of claim 1, wherein said printing head includes a rotatable type wheel having said types arrayed about its periphery.

3. The label printing machine of claim 1, wherein said arranging surface is flat.

4. The label printing machine of claim 1, further comprising an operating lever connected with said printing head and with said feed means for being moved to in turn operate said feed means to move the label strip and for moving said printing head toward and away from said platen.

5. The label printing machine of claim 4, wherein said feed means comprises a rotatable feed wheel having said feed pins thereon and rotatable therewith; said operating lever being so connected with said feed wheel so as to rotate said feed wheel.

6. The label printing machine of claim 5, wherein said printing head includes a rotatable type wheel having said types arrayed about its periphery.

7. In combination, the label printing machine of claim 6, and a label strip;

said label strip being adapted to be pierced by said feed pins, thereby to define upraised feed lips for being engaged by said arranging surface;

said label strip being comprised of a backing strip and a plurality of label pieces removably adhered to said backing strip; said label strip being oriented such that said label pieces face toward said types and toward said arranging surface; said feed pins being placed to pierce said label strip from the side thereof of said backing strip.

8. The label printing machine of claim 1, wherein said feed means comprises a rotatable feed wheel having said feed pins thereon and rotatable therewith.

9. In combination, the label printing machine of claim 1; and a label strip;

said label strip being adapted to be pierced by said feed pins, thereby to define upraised feed lips for being engaged by said arranging surface.

10. The combination of claim 9, wherein said label strip is comprised of a backing strip and a plurality of label pieces removably adhered to said backing strip; said label strip being oriented such that said label pieces face toward said types and toward said arranging surface; said feed pins being placed to pierce said label strip from the side thereof of said backing strip.

* * * * *